US005688153A

United States Patent [19]

Yeung

[11] Patent Number: 5,688,153

[45] Date of Patent: Nov. 18, 1997

[54] INFLATABLE FLOATING CHAIR

[75] Inventor: Man Fu Yeung, Rowland Heights, Calif.

[73] Assignee: Sunco Products, Inc., Industry, Calif.

[21] Appl. No.: 633,439

[22] Filed: Apr. 17, 1996

Related U.S. Application Data

[63] Continuation-in-part of Ser. No. 492,375, Jun. 19, 1995, Pat. No. 5,570,480.

[51] Int. Cl.[6] ..... B63C 9/08

[52] U.S. Cl. ..... 441/132

[58] Field of Search ..... 441/130, 131, 441/132

[56] References Cited

U.S. PATENT DOCUMENTS

| | | | |
|---|---|---|---|
| 1,562,276 | 11/1925 | Assenzio | 441/132 |
| 1,598,457 | 8/1926 | Sommer | 441/131 |
| 2,980,927 | 4/1961 | Waters | 441/132 |
| 3,748,672 | 7/1973 | Patrick et al. | 441/131 |
| 5,518,431 | 5/1996 | Staley | 441/130 |

*Primary Examiner*—Stephen Avila

*Attorney, Agent, or Firm*—Stein, Pendorf & Van Der Wall

[57] ABSTRACT

An inflatable floating chair comprising a floatation means for providing support, a seat, and an adjustable seat support means for supporting said seat at various positions relative to said floatation means whereby the inflatable floating chair accommodates bathers of various sizes and serves to support a barber's head and shoulders above the water surface.

13 Claims, 4 Drawing Sheets

INFLATABLE FLOATING CHAIR

CROSS-REFERENCE TO RELATED APPLICATION

This application is a continuation-in-part application of Ser. No. 08/492,375, filed Jun. 19, 1995, the disclosure of which is hereby incorporated by reference herein.

BACKGROUND OF THE INVENTION

1. Field of the Invention

This invention relates to a floating chair and, more particularly, to an inflatable floating chair to be used by a bather or swimmer while reclining in water.

2. Description of the Background Art

Presently, many types of floating chairs are known and are in wide use today throughout the water-related industry. Many of the prior art floating chairs are of a rigid, semi-permanent structural design which prevents their being easily collapsed and stored away when not in use. Thus, many of the current prior art floating chairs are cumbersome and tend to be marginally portable.

Further, many of the current prior art floating chairs do not include an adjustable seat support means whereby a seat is adjustable relative to the floatation means. Thus, the floating chairs of the prior art tend to be a one size fits all type of structure. This leads to the problem of having different size swimmers or bathers use the floating chair while not properly being kept afloat or while the chair becomes unstable. With different size bathers or swimmers using the chair, an unadjustable seat on a floating chair may not provide for the keeping of the head and shoulders of the bathers out of the water.

Another problem associated with the prior art floating chairs is that the manufacture and assembly is complex and time-consuming due to mechanical aspects thereby adding additional costs to their manufacture.

Of the floating chairs currently available in the industry today that provide for some aspect of adjustability in the structure, the adjustment procedure is cumbersome and not easily accomplished thereby often requiring the adjustment to be performed prior to use.

Therefore, it is an object of this invention to provide an improvement which overcomes the aforementioned inadequacies of the prior art devices and provides an improvement which is a significant contribution to the advancement of the floating chair art.

Another object of this invention is to provide a floating chair that is easily collapsible so to be folded and stored away when not in use.

Another object of this invention is to provide a floating chair that suspends a bather in the water while keeping the bather's head and shoulders out of the water.

Another object of this invention is to provide an inflatable floating chair that includes an adjustable seat which can be adjusted to suit the size of the bather or swimmer.

Another object of this invention is to provide an anchoring means on the inflatable floating chair that includes a means for quick releasable securement of the seat in its various adjusted positions.

Another object of this invention is to provide quick clips that are positioned about the floatation means of the inflatable floating chair that facilitate the connecting together of multiple floating chairs.

Another object of this invention is to provide an inflatable floating chair that is easy to manufacture and assemble.

Another object of this invention is to provide an inflatable floating chair for recreational use in water comprising in combination: a floatation means for supporting the inflatable floating chair, the floatation means having a submerged side and a top side; a seat, the seat being positioned below and in relative alignment with the floatation means; and an adjustable seat support means for supporting the seat at various positions relative to the floatation means, the adjustable seat support means having an upper portion and a lower portion, the upper portion being coupled to the floatation means and the lower portion being coupled to the seat to thereby suspend the seat from the floatation means, whereby the adjustable seat support means varies the vertical distance between the floatation means and the seat such that the inflatable floating chair facilitates swimmers of all sizes thereby keeping their shoulders and head above water while the rest of their body is suspended below the water surface.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing this invention, this invention comprises an inflatable floating chair for recreational use in water having a floatation means, a seat, and an adjustable seat support means for supporting the seat at various positions relative to the floatation means. The adjustable seat support means includes a first support member, a second support member, a first rope means and a second rope means. The upper portion of the first and second support members is coupled to the floatation means and the seat suspends downward from the floatation means coupled to the lower portion of the first and second support members. The first and second rope means are used to perform the adjustment action so to vary the position of the seat relative to the floatation means.

The first and second rope means are coupled to the seat at their lower ends by way of passing through a first and second rope eyelet, respectively. The upper ends of the first and second rope means are coupled to the floatation means by way of a first and second anchoring means, respectively. The first and second anchoring means facilitate releasably coupling the first and second rope means, respectively, when the seat position is varied to accommodate the size of a swimmer.

The first and second support members are formed from a transparent sheet material that is non-water permeable and further include a first and second rope guide respectively coupled thereto. The first and second rope guides facilitate the retaining of the first and second rope means in relative alignment with the respective first and second anchoring means. As to the floatation means, it is comprised mainly of an air chamber generally U-shaped in nature having a first air valve coupled thereto.

In use, the swimmer sits on the seat and is suspended submerged in the water with their shoulders and head held above the water resting on the air chamber. Thus, depending on the size of the swimmer, the first and second rope means can be adjusted so as to place the seat in a position relative to the air chamber wherein the swimmer's head and shoulders would be positioned slightly above the air chamber so to be held out of the water. However, the rest of the swimmer's body remains submerged under the water suspended there by support from the air chamber and the seat.

Upon completing use of the inflatable floating chair, simple deflating of the air chamber and the seat allows for the folding thereof for easy removal and storage.

An important feature of the present invention is that the inflatable floating chair is collapsible so to be easily folded for removal and storage.

Another feature of the present invention is that the inflatable floating chair suspends a bather in the water so to keep the bather's head and shoulders out of the water while the rest of the bather's body remains suspended submerged in the water.

Another feature of the present invention is that the inflatable floating chair includes an adjustable seat support means that facilitates the adjusting of the seat relative to the floatation means so to accommodate bathers of different sizes.

Another feature of the present invention is that the inflatable floating chair includes a first and second anchoring means for the quick releasable securement of the seat during adjustment thereof.

Another feature of the present invention is that the inflatable floating chair utilizes quick clips positioned about the floatation means to facilitate the coupling of multiple inflatable floating chairs together so as to keep the floating chairs close to one another.

Another feature of the present invention is that the inflatable floating chair is easy to manufacture and assemble in that the majority of assembly is by way of a sealing process such as electronically welding thereby reducing manufacturing costs. Therefore, it can be readily appreciated that the present invention overcomes the inadequacies of the prior art and simplifies the inflatable floating chair's use while providing for an adaptability in its use with bathers of various sizes.

The foregoing has outlined rather broadly the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be had to the following detailed description taken in conjunction with the accompanying drawings in which.

Similar reference characters refer to similar parts throughout the several views of the drawings.

DETAILED DESCRIPTION OF THE PREFERRED EMBODIMENT

Figure 1:
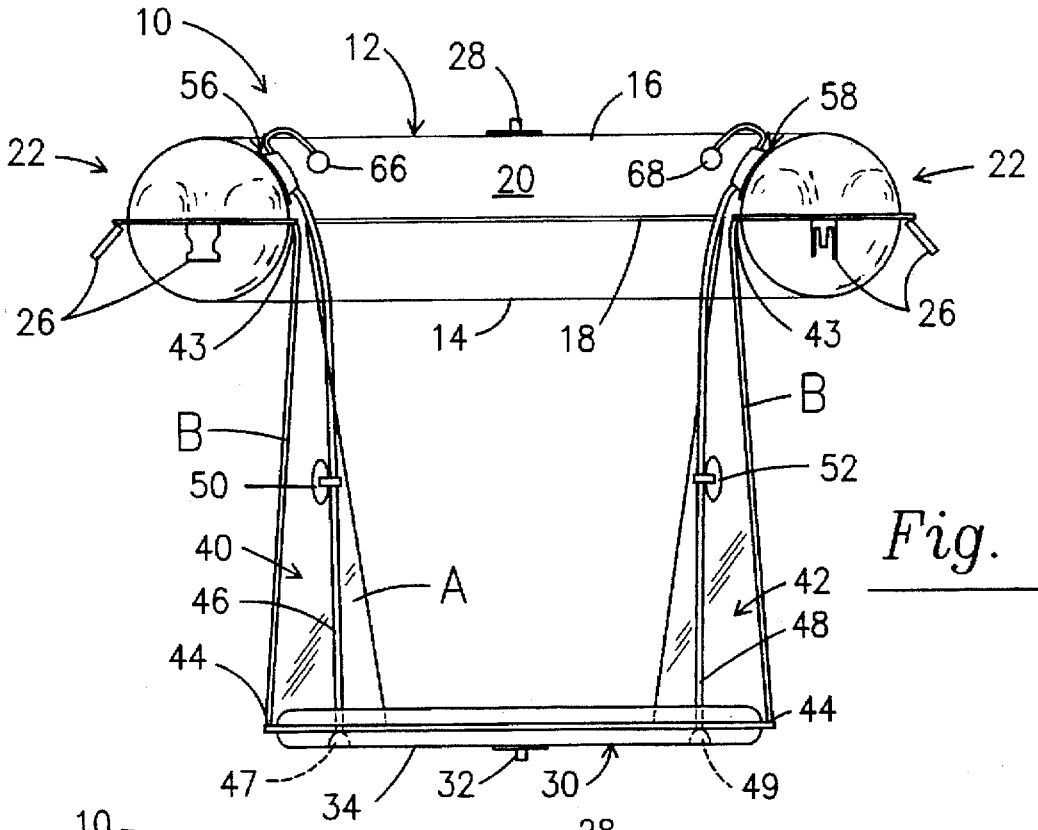
FIG. 1 is a front elevational view of the inflatable floating chair showing the relative positions of the first and second support members, the seat and the air chamber.
Figure 2:
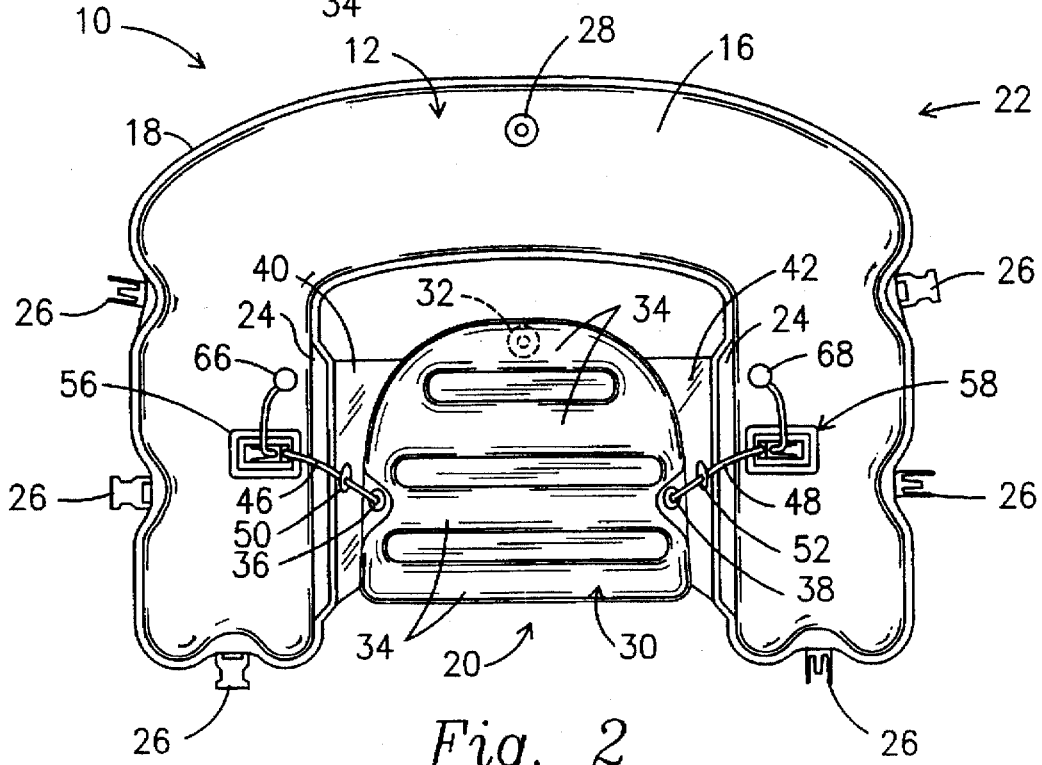
FIG. 2 is a top plan view of the inflatable floating chair showing the air chamber, the first and second rope means, the first and second anchoring means, the first and second support members and the seat in their relative positions to each other.

In referring now to FIGS. 1 and 2, the inflatable floating chair 10 can be seen as illustrated in a front elevational view and a top plan view, respectively. The inflatable floating chair 10 is shown to include a floatation means that is comprised of an air chamber 12. The air chamber 12 is generally U-shaped in nature and includes a submerged side 14 and a top side 16. Further, the air chamber 12 includes a perimeter seam 18 formed during manufacture by way of a sealing process such as electronic welding. The air chamber 12 is preferably formed from a non-water permeable material such as a pliable nylon that can readily be formed into structures using a sealing process.

Figure 4:
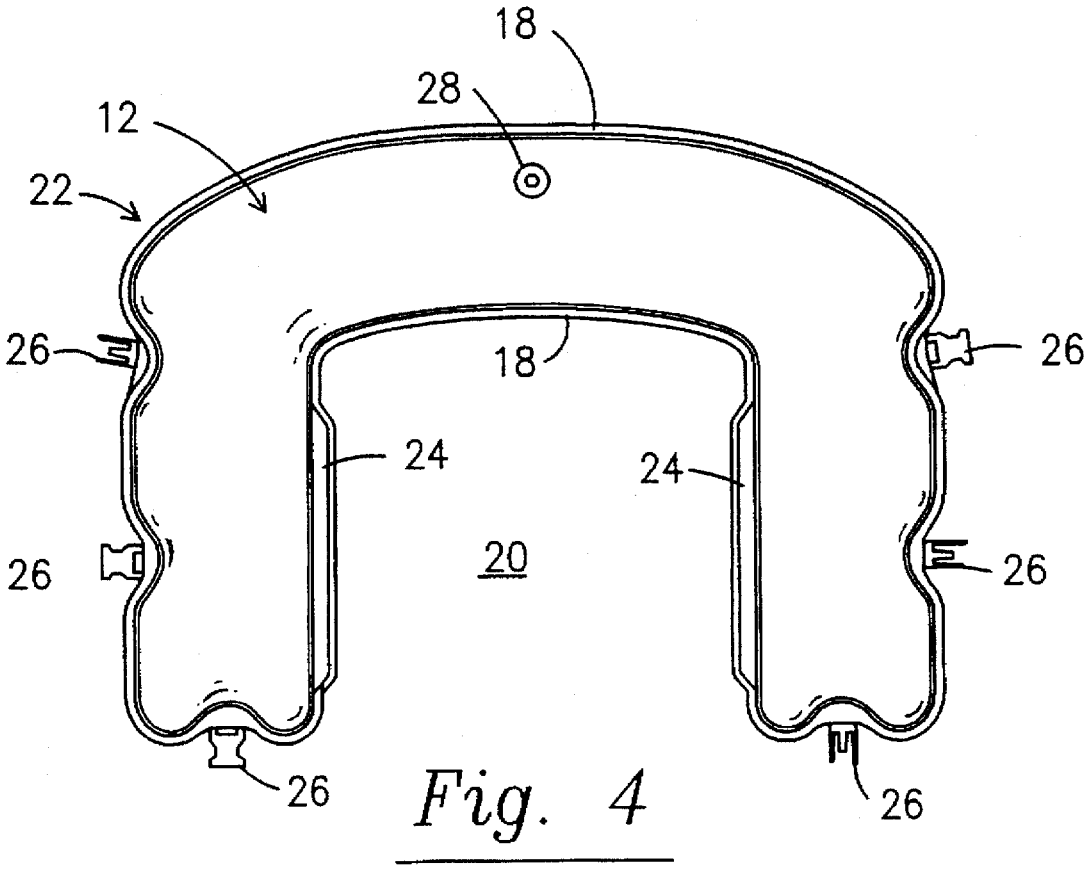
FIG. 4 is a top plan view of the air chamber illustrating the perimeter seal, the edge extension, the first air valve and the plurality of quick clips in their various positions.
Figure 5:
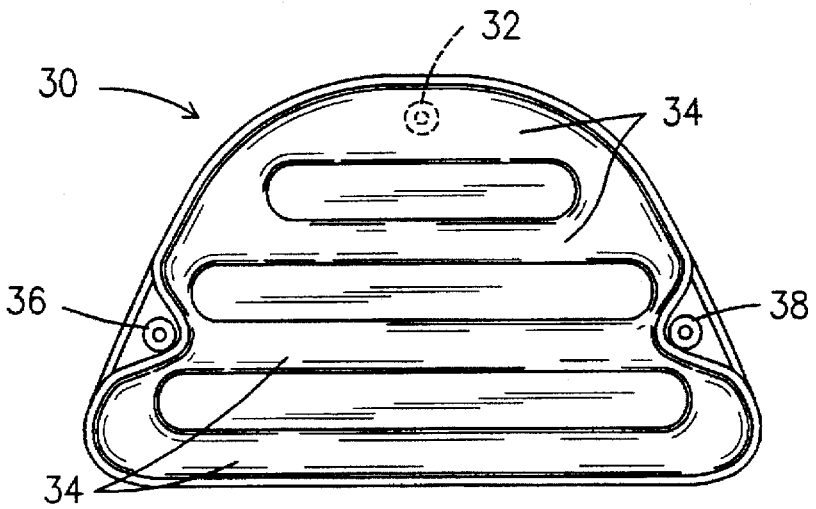
FIG. 5 is a top plan view of the seat illustrating the plurality of integral chambers, the first and second rope eyelets, and the second air valve in their relative positions to each other.

The air chamber 12, having a general U-shaped design, has an internal side 20 and an external side 22 (see FIG. 4). As can readily be seen in FIGS. 2 and 4, the perimeter seam 18 located on the internal side 20 of the air chamber 12 includes an edge extension 24 that extends outward therefrom.

In addition, the air chamber 12 further includes a plurality of quick clips 26 that are positioned about the external side 22 of the air chamber 12. To facilitate filling the air chamber 12 with air, a first air valve 28 is located toward the rear of the air chamber 12. The first air valve 28 is of the conventional type air valve used commonly in the industry and is preferably sealed to the air chamber 12 by a sealing process such as electronic welding.

In now referring to FIGS. 1, 2, 3 and 5, the seat 30 can be seen in various views illustrating its general shape and relative positioning to the air chamber 12. The seat 30 includes a second air valve 32 (see FIGS. 3 and 5) that is of the conventional air valve type used commonly in the industry. The second air valve 32 is preferably sealed to the seat 30. In referring primarily to FIGS. 2 and 5, the seat 30 can be seen to include a plurality of integral chambers 34 of which have fluid communication with one another. Thus, air entering through the second air valve 32 will serve to fill the entire plurality of integral chambers 34.

Further, the seat 30 can be seen to include a first rope eyelet 36 and a second rope eyelet 38. The first and second rope eyelets 36 and 38 are preferably sealed to the seat 30. The first and second rope eyelets 36 and 38 are positioned at opposite sides of the seat 30 and provide a point of coupling of the seat 30 relative to the air chamber 12.

Figure 3:
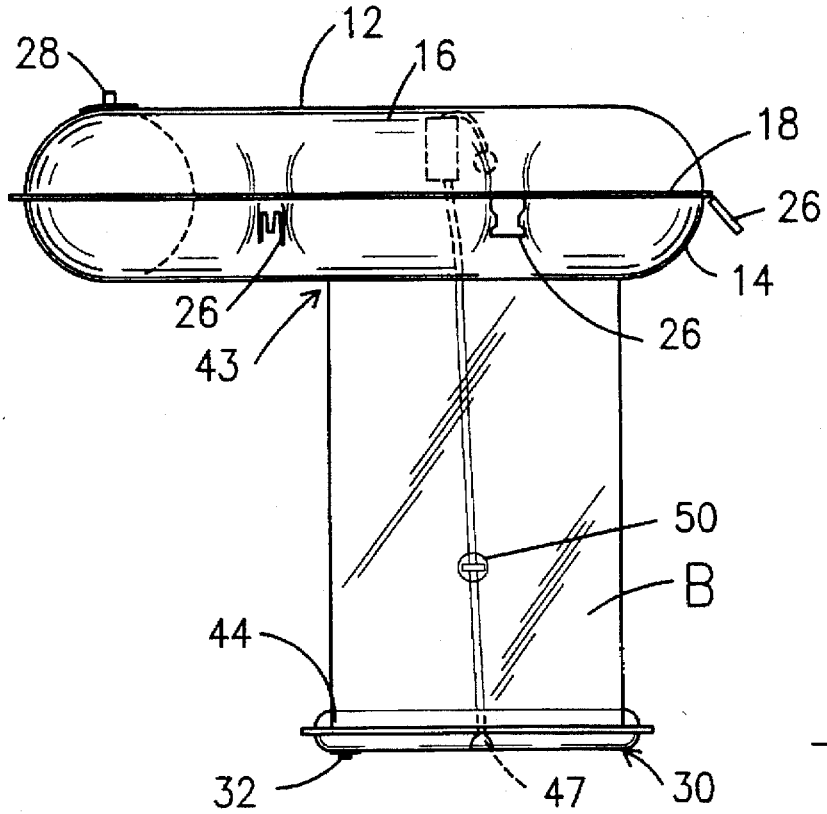
FIG. 3 is a side elevational view of the inflatable floating chair showing the seat having a second air valve, and the first support member having a first rope guide in their relative positions to each other.

In now referring primarily to FIGS. 1, 2 and 3, the inflatable floating chair 10 is shown to further include an adjustable seat support means comprised of a first support member 40 and a second support member 42. The first and second support members 40 and 42 each have an upper portion 43, a lower portion 44, an inside surface A and an outside surface B. The upper portion 43 of the first and second support members 40 and 42 is coupled to the edge extension 24 extending outward from the perimeter seam 18 of the air chamber 12. Preferably, the upper portion 43 of the first and second support members 40 and 42 is sealed to the edge extension 24. The first and second support members 40 and 42 are preferably made from a pliable non-water permeable material which can be readily utilized in sealing processes. In the preferred embodiment, the first and second support members 40 and 42 are formed from a transparent material.

The adjustable seat support means is further comprised of a first rope means 46 and a second rope means 48 for suspending said seat 30 at various vertical distances from said floatation means. The first and second rope means 46 and 48 each have an upper and lower end. The lower end of the first rope means 46 is coupled to the first rope eyelet 36 of the seat 30 and the lower end of the second rope means 48 is coupled to the second rope eyelet 38 of the seat 30.

In the preferred embodiment, the lower ends of the first and second rope means 46 and 48 are slipped through their respective first and second rope eyelets 36 and 38 and then through a first and second stop bead 47 and 49, respectively. Once the first and second rope means 46 and 48 have passed through the first and second stop beads 47 and 49, the lower ends of the first and second rope means 46 and 48 are individually tied into a knot so to prevent the first and second stop beads 47 and 49 from slipping off. The first and second stop beads 47 and 49 are sized so as not to be capable of sliding through the first and second rope eyelets 36 and 38. Thus, the first and second rope means 46 and 48 are coupled at their lower ends to the seat 30 by way of the first and second rope eyelets 36 and 38 and the first and second stop beads 47 and 49. Simple knots may sufficient in lieu of the beads 47 & 49.

Figure 6:
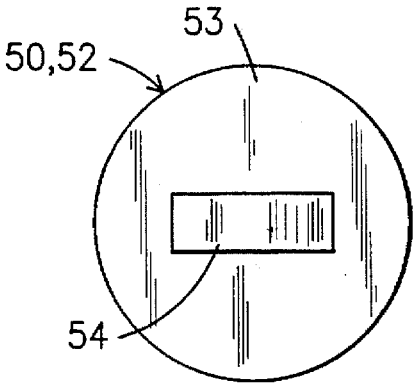
FIG. 6 is a top plan view of a rope guide as used in the present invention.
Figure 8:
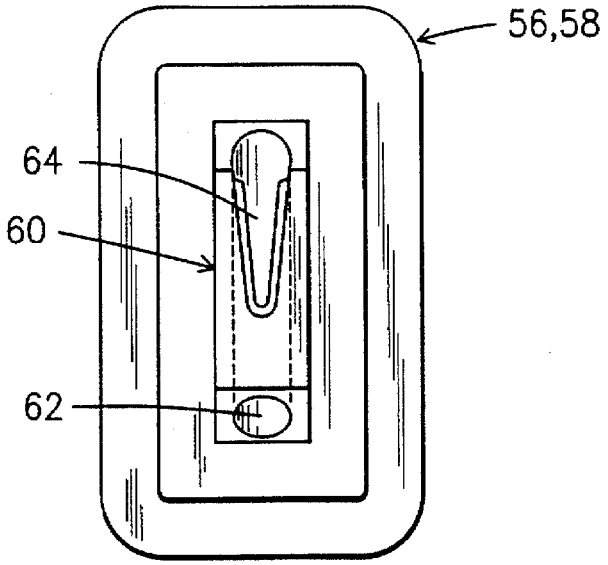
FIG. 8 is a top plan view of the anchoring means illustrating its general shape and the relative positioning of the central bore and the groove portion.
Figure 7:
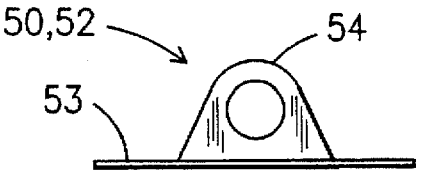
FIG. 7 is a side elevational view of the rope guide of FIG. 6.
Figure 9:
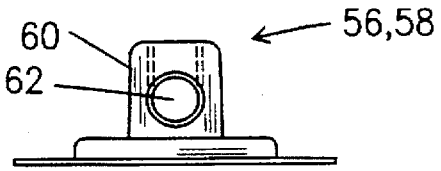
FIG. 9 is a front elevational view of the anchoring means illustrating the positioning of the central bore and the groove portion therein.

In addition, the first and second support members 40 and 42 further include a first rope guide 50 and a second rope guide 52 (see FIGS. 1, 2 and 3). The first and second rope guides 50 and 52 are coupled to the inside surface A of the first and second support members 40 and 42, respectively, intermediate to their respective upper and lower ends. FIGS. 6 and 7 show a front top view of a rope guide of the type used herein.

The first and second rope guides 50 and 52 are comprised primarily of a base 53 and a ring portion 54. The ring portion 54 extends out from and is integral with the base 53. The ring portion 54 of the first and second rope guides 50 and 52 is designed to receive the first and second rope means 46 and 48, respectively so as to loosely retain the first and second rope means 46 and 48 in relative alignment with the first and second support members 40 and 42. The first and second rope guides 50 and 52 are preferably formed from a pliable non-water permeable material whereby the base 53 thereof is readily sealed to the first and second support members 40 and 42.

The upper ends of the first and second rope means 46 and 48 are coupled to the air chamber 12 by way of a respective first anchoring means 56 and a second anchoring means 58. The first and second anchoring means 56 and 58 are generally each comprised of an elongated body 60 having a central bore 62 and a groove portion 64. The groove portion 64 incorporates a decreasing width so to facilitate frictionally engaging the first and second rope means 46 and 48 within the respective first and second anchoring means 56 and 58. The first and second anchoring means 56 and 58 are preferably formed from a non-corrosive polymer-type material that is readily sealable to the air chamber 12.

Thus, the upper ends of the first and second rope means 46 and 48 are received by the central bore 62, continue through the elongated body 60 and exit through the groove portion 64 of the respective first and second anchoring means 56 and 58. Once through the first and second anchoring means 56 and 58, the upper ends of the first and second rope means 46 and 48 are terminated in a similar manner as were the lower ends. The upper end of the first rope means 46 slips through a third stop bead 66 whereupon the upper end of the first rope means 46 is tied in a knot so as to prevent the third stop bead from slipping off. Similarly, the upper end of the second rope means 48 is slid through a fourth stop bead 68 whereupon the upper end of the second rope means 48 is tied in a knot so as to prevent the fourth stop bead from sliding off. The third and fourth stop beads 66 and 68 facilitate precluding the upper ends of the first and second rope means 46 and 48 from sliding out of the first and second anchoring means 56 and 58 when being adjusted.

Thus, when the seat 30 is being adjusted relative to the air chamber 12, the upper ends of the first and second rope means 46 and 48 are pulled up through the first and second anchoring means 56 and 58, respectively until the seat 30 has been adjusted to a desired position. Once the seat 30 is in its desired position, the upper ends of the first and second rope means 46 and 48 are slid down the groove portion 64 of the respective first and second anchoring means 56 and 58 so as to releasably secure the seat 30 in its adjusted position. Thus, by pulling down, the upper ends of the first and second rope means 46 and 48 are forced down the groove portion 64 to gradually engage the decreasing width until they are firmly secured in place.

In contrast, in order to re-adjust the position of the seat 30 relative to the air chamber 12, the upper ends of the first and second rope means 46 and 48 are pulled upward to thereby disengage the first and second rope means 46 and 48 from the groove portion 64 of the respective first and second anchoring means 56 and 58 whereupon the first and second rope means 46 and 48 can be slid accordingly through the respective first and second anchoring means 56 and 58 to a new desired position and subsequently re-engaged with the groove portion 64 as similarly explained above. The first and second rope means 46 and 48 are preferably formed from a flexible non-corrosive material exhibiting a tinsel strength capable of supporting swimmers of various sizes suspended in the water. Similarly, the first and second anchoring means 56 and 58 are preferably from a non-corrosive polymer material exhibiting a tinsel strength of substantial degree so as to withstand a force necessary to support a swimmer suspended in water. In the preferred embodiment, the first and second rope of means 46 and 48 are formed from a nylon woven rope of a ¼" in diameter commonly used in the industry.

Figure 10:
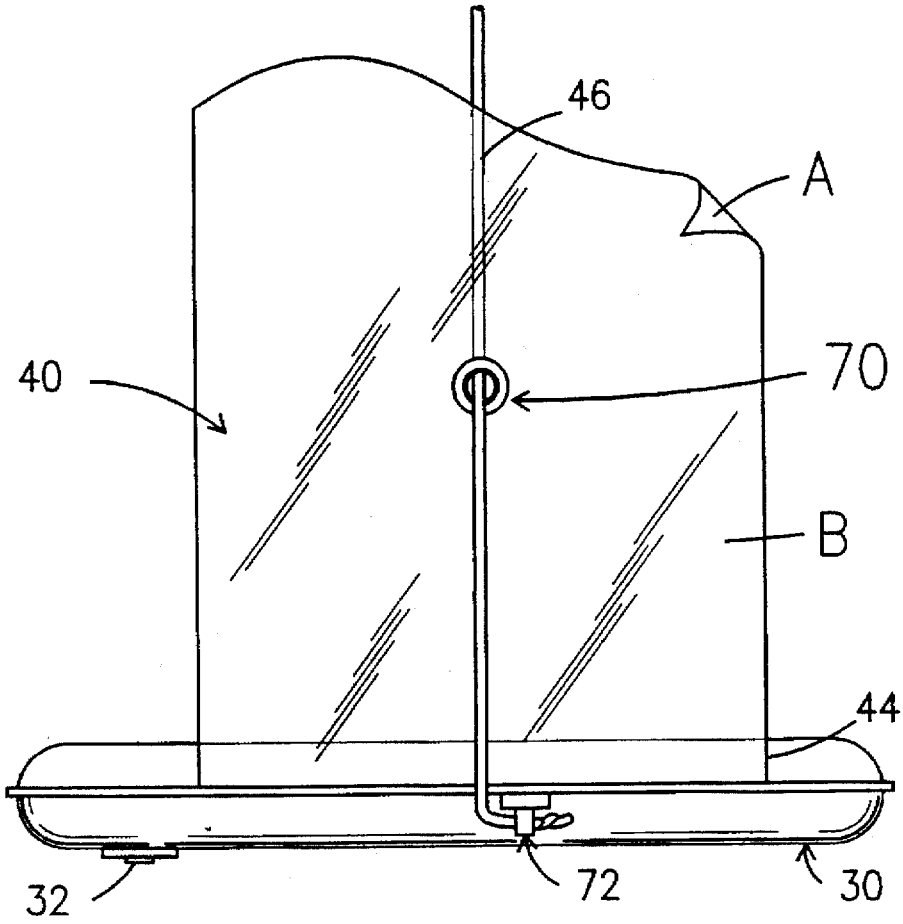
FIG. 10 is a partial side elevational view of the first support member, the seat, the first rope means, the first rope ring and the first securing eyelet in their relative positions to each other as used in an alternate embodiment of the inflatable floating chair.
Figure 11:
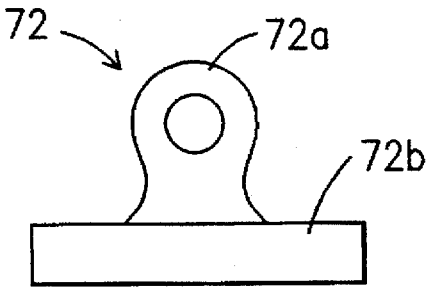
FIG. 11 is side elevational view of the securing eyelet used in an alternate embodiment showing the loop portion and base portion thereof.
Figure 12:
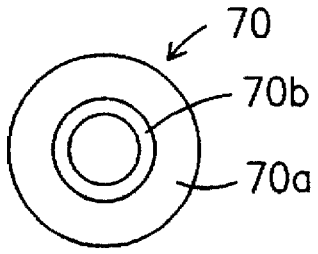
FIG. 12 is top plan view of the rope ring used in an alternate embodiment showing the fixation region and ring portion thereof.

In referring now to FIGS. 10, 11 and 12, an alternate embodiment of the inflatable floating chair 10 can be seen in part. For clarity and, since the inflatable floating chair 10 is symmetrical about the seat 30, only the first support member 40 and seat 30 will be described as they relate to the alternate embodiment. The alternate embodiment is comprised of the utilization of a first rope ring 70 coupled to the first support member 40 in substitution for the first rope guide 50. The rope ring 70 includes a fixation region 70*a* and a ring region 70*b*. The first rope ring 70 is preferably coupled to the inside surface A of the first support member 40 by way of sealing the fixation region 70*a* thereto. Similarly, a second rope ring (not shown) is coupled to the second support member 42 in like manner.

Further, the alternate embodiment includes a first securing eyelet 72 coupled to the seat 30 in substitution for the first rope eyelet 36. The first securing eyelet 72 includes a loop portion 72*a* and a base portion 72*b*. The first securing eyelet 72 is preferably coupled to the underside of the seat 30 by way of sealing the base portion 72*b* thereto. Similarly, a second securing eyelet (not shown) is coupled to the underside of the seat 30 in like manner in a position opposite the first securing eyelet 72 and in alignment with the second support member 42.

The first rope means 46 extends downward from the first anchoring means 56 adjacent the inside surface A of the first support member 40 until passing through the first rope ring 70 whereupon the first rope means 46 continues to extend downward adjacent the outside surface B of the first support member 40 until finally passing through the first securing eyelet 72. The first rope means 46, after passing through the first securing eyelet 72, is then terminated in a tied knot of such size so as to prevent the first rope means 46 from passing back through the first securing eyelet 72. Similarly, the second rope means 48 is secured in position relative to the second support member 42 and seat 30 in a like manner using the second rope ring (not shown) and second securing eyelet (not shown).

In operation, the inflatable floating chair 10 is unfolded whereupon the air chamber 12 is inflated via the first air valve 28 and the seat 30 is inflated via the second air valve 32. After inflation, the inflatable floating chair 10 is ready for use. Upon completion of use, the air chamber 12 and seat 30 can then be deflated via the first and second air valves 28 and 32, respectively. After deflation, the inflatable floating chair 10 can be easily folded and stored away for future use.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An inflatable floating chair for recreational use in water comprising in combination:

a floatation means for supporting said inflatable floating chair, said floatation means having a submerged side and a top side;

a seat, said seat being positioned below and in relative alignment with said floatation means; and an adjustable seat support means for supporting said seat at various positions relative to said floatation means, said adjustable seat support means having an upper portion and a lower portion, a first and second rope means for suspending said seat at various vertical distances from said flotation means, and a first and second rope guide, said upper portion being coupled to said floatation means and said lower portion being coupled to said seat to thereby suspend said seat from said floatation means, said first and second rope means being coupled relative to said flotation means and said seat, said first and second rope guide being coupled to said adjustable seat support means with said first and second rope means passing therethrough respectively, whereby said adjustable seat support means varies the vertical distance between said floatation means and said seat such that said inflatable floating chair facilitates swimmers of all sizes thereby keeping their shoulders and head above water while the rest of their body is suspended below the water surface supported by said seat.

2. The inflatable floating chair as recited in claim 1, wherein said floatation means is comprised of an air chamber having a perimeter seam and a first air valve.

3. The inflatable floating chair as recited in claim 1, wherein said adjustable seat support means is comprised of a first and a second support member each having an inside surface and an outside surface, said upper portion of said first and second support members being coupled to said floatation means and said lower portion of said first and second support members being coupled to said seat whereby said first and second rope means are secured at various lengths so to adjust the position of said seat relative to said floatation means.

4. The inflatable floating chair as recited in claim 2, wherein said air chamber is U-shaped having an internal side and an external side.

5. The inflatable floating chair as recited in claim 4, wherein said perimeter seam on said internal side of said air chamber includes an edge extension whereupon said upper portion of said adjustable seat support means is coupled thereto.

6. The inflatable floating chair as recited in claim 1, wherein said seat further includes a first and a second rope eyelet coupled thereto, said first rope eyelet receiving said first rope means therethrough and said second rope eyelet receiving said second rope means therethrough.

7. The inflatable floating chair as recited in claim 3, wherein said floatation means further comprises a first and a second anchoring means for releasably securing said first and second rope means respectively in adjusted positions so to maintain said seat in a preferred position relative to said floatation means, said first and second anchoring means being couple to said floatation means in cooperative alignment with said first and second support members respectively.

8. The inflatable floating chair as recited in claim 7, wherein said first and second anchoring means are comprised of an elongated body having a center bore and a groove portion, said groove portion having a width that decreases along the longitudinal axis of said body whereby said groove portion receives said rope means so as to frictionly wedge said rope means in a releasably secured fashion therein.

9. The inflatable floating chair as recited in claim 2, wherein said seat further includes a plurality of integral chambers and a second air valve coupled thereto, said plurality of chambers being in fluid communication with each other.

10. The inflatable floating chair as recited in claim 3, wherein flotation means, said seat, and said first and second support members are made from a water impervious material.

11. The inflatable floating chair as recited in claim 1, wherein said floatation means includes a plurality of quick clips coupled thereto so to facilitate the securing together of multiple said inflatable floating chairs.

12. The inflatable floating chair as recited in claim 3, wherein said first and second support members further include a first and a second rope ring respectively, said first rope ring being coupled to said first support member with said first rope means passing therethrough to the outside surface of said first support member and said second rope ring being coupled to said second support member with said second rope means passing therethrough to the outside surface of said second support member.

13. The inflatable floating chair as recited in claim 12, wherein said seat has an underside and further includes a first and second securing eyelet coupled to said underside, whereupon said first and second rope means pass through and releasably couple to said first and second securing eyelets respectively.

* * * * *